United States Patent [19]

Takahashi et al.

[11] Patent Number: 4,795,999

[45] Date of Patent: Jan. 3, 1989

[54] THERMAL TRANSFER TYPE PRINTER

[75] Inventors: Fumio Takahashi; Hiromitsu Ogita, both of Ise, Japan

[73] Assignee: Shinko Electric Co., Ltd., Tokyo, Japan

[21] Appl. No.: 69,822

[22] Filed: Jul. 6, 1987

[30] Foreign Application Priority Data

Jul. 18, 1986 [JP] Japan ..... 61-169405

[51] Int. Cl.[4] ..... H01C 10/00

[52] U.S. Cl. ..... 346/76 PH; 400/120

[58] Field of Search ..... 346/76 PH, 136; 400/120, 124; 355/3 TR

[56] References Cited

U.S. PATENT DOCUMENTS

| | | | |
|---|---|---|---|
| 3,725,898 | 4/1973 | Canton | 346/76 PH |
| 3,840,878 | 10/1974 | Houston et al. | 346/62 |
| 3,929,215 | 12/1975 | Hayakawa | 197/1 R |
| 4,025,182 | 5/1977 | Goel | 355/4 |
| 4,091,913 | 5/1978 | Ku et al. | 400/124 |
| 4,194,829 | 3/1980 | Cavagnaro | 355/3 TR |
| 4,376,942 | 3/1983 | Toth et al. | 346/76 PH |
| 4,388,628 | 6/1983 | Moriguchi et al. | 346/76 PH |
| 4,416,534 | 11/1983 | Kluger | 355/14 SH |
| 4,537,493 | 8/1985 | Russel | 355/3 SH |
| 4,586,834 | 5/1986 | Hachisuga et al. | 400/120 |
| 4,651,167 | 3/1987 | Moriguchi et al. | 346/76 PH |

*Primary Examiner*—E. A. Goldberg
*Assistant Examiner*—M. Lateef
*Attorney, Agent, or Firm*—Hoffmann & Baron

[57] ABSTRACT

A thermal transfer type printer consists of a thermal head, a platen roller, a printing control circuit, a reflection type photo sensor, a printing paper, and a transfer film on which thermal melting ink is painted. One of at least two kinds of printing papers is selectively used. The printing paper and the transfer film are lapped and pressurized between the thermal heat and the platen roller when the printing operation is performed. The intensity of light reflected by the printing paper varies in accordance with the kind of the printing paper which is actually used. The photo sensor emits the light to the printing paper and outputs a detection signal corresponding to the intensity of the light refleted by the printing paper. The printing control circuit changes the heating values of the heating elements within the thermal head based on the detection signal. Thus, the thermal head is heated to an optimum temperature in response to the kind of printing paper.

5 Claims, 3 Drawing Sheets

THERMAL TRANSFER TYPE PRINTER

BACKGROUND OF THE INVENTION

1. Field of the Invention

The present invention generally relates to thermal transfer type printers, and more particularly to a thermal transfer type printer in which optimum heating value for each heating element is automatically selected in accordance with the kind of printing paper.

2. Prior Art

FIG. 1 shows a diagrammatic constitution of a conventional thermal transfer type printer. In FIG. 1, 1 designates a supply bobbin for being wound by a transfer film 2 and for rotating in a direction A so as to feed forward the transfer film 2, 3 designates a take-up bobbin for rotating in a direction B so as to take up the used transfer film 2, and 4 designates a take-up motor for driving the take-up bobbin 3 to rotate. In addition, 5 designates a main sprocket pin feed wheel (hereinafter, referred to as a platen roller) which rotates in a direction C so as to draw in and feed forward a printing paper P in a direction D, and 6 designates an auxiliary sprocket pin feed wheel (hereinafter, referred to as an auxiliary wheel) for rotating in a direction E. Furthermore, 15 designates a thermal head arranged by a plurality of heating elements along the line, and the thermal head 15 is supported by a shaft (not shown) so that the thermal head 15 can move in a radius direction. When the platen roller 5 is forced to move toward the shaft direction, the transfer film 2 and the printing paper P are lapped and pressurized between an outer surface of the platen roller 5 and the heating portion provided with the heating elements within the thermal head 15.

In the above state, the heating elements within the thermal head 15 are heated in accordance with an arbitrary heating pattern, hence, thermal melting ink painted on the transfer film 2 is melted and transferred on the printing paper P in accordance with the arbitrary heating pattern. Thus, the printing operation of first line is performed. The rotating force of drive motor (not shown) is transmitted to the platen roller 5 via a belt 7 and a belt pulley 8 so that the platen roller 5 rotates in the direction C. The rotating force of the platen roller 5 is transmitted to the auxiliary wheel 6 via a belt pulley 9 and a belt 10 so that the auxiliary wheel 6 rotates in the direction E. Hence, the printing paper P is fed forward by a one line distance. At the same time, the take-up bobbin 3 is rotated by the take-up motor 4 in the direction B so that the transfer film 2 is taken up by one line distance. Similarly, a transfer operation of one line and a paper feeding operation of one line is repeatedly performed in turn so that the printing operations of second, third and other lines will be sequentially performed.

In the above-mentioned thermal transfer type printer, a density setting switch is provided on a operation panel, and an optimum printing density can be arbitrarily selected only by operating the density setting switch. In order to obtain a high printing density, the heating value of each heating element must be enlarged by enlarging the value of the current supplied to each heating element or by enlarging a current-on time when the current flows through the heating element. Therefore, the current-on time for the each heating element within the thermal head 15 is selected to an optimum current-on time by use of the density setting switch so that the printing density will be set to an optimum printing density.

Meanwhile, the ordinary paper and a transparent sheet for an overhead projector (OHP) can be applied to the conventional thermal transfer type printer. In the case where the image is printed on the transparent paper for OHP, the heating value of each heating element within the thermal head 15 must be set lower than that in the case where the image is printed on the ordinary paper. Compared to the ordinary paper, the transparent sheet for OHP has lower thermal conductivity and higher smoothness of the surface thereof. When the thermal transfer printing is performed at a high temperature, the bleeding will be generated and the transfer film 2 will be transformed because of the high temperature. Hence, a good printing quality can not be obtained in some cases.

Therefore, in the case where the thermal transfer printing is performed on the transparent sheet for OHP, low printing density must be selected by the density setting switch and the heating value of each heating element within the thermal head 15 will be set to a relatively low heating value. However, the density setting switch must be operated at every time when the ordinary paper is exchanged for the transparent sheet and when the transparent sheet is exchanged for the ordinary paper. Hence, the conventional printer is disadvantageous in that it is complicated and troublesome for the operator to select the optimum density by use of the density setting switch. In addition, the conventional printer is disadvantageous in that there is a possibility in which the printing paper will be printed with undesirable printing density when the density setting switch is operated and the undesirable printing density is selected by mistake.

SUMMARY OF THE INVENTION

It is therefore a primary object of the invention to provide a thermal transfer type printer in which the optimum heating value of each heating element within the thermal head can be automatically selected in accordance with the kind of the printing paper.

It is another object of the invention to provide a thermal transfer type printer in which the optimum printing density can be obtained without mistake.

It is still another object of the invention to provide a thermal transfer type printer in which the density setting switch can be omitted and the thermal transfer printing can be performed with ease and with relatively high efficiency.

In one aspect of the invention, there is provided a thermal transfer type printer comprising: (a) detection means for emitting light to the printing paper which is actually used and detecting the kind of the printing paper based on the light reflected by the printing paper, the detection means outputting a detection signal corresponding to the kind of the printing paper; and (b) control means for changing heating values of the heating elements based on the detection signal when the heating elements are to be heated.

BRIEF DESCRIPTION OF THE DRAWINGS

Further objects and advantages of the present invention will be apparent from the following description, reference being had to the accompanying drawings wherein a preferred embodiment of the present invention are clearly shown.

In the drawings.

DESCRIPTION OF THE PREFERRED EMBODIMENT

Figure 1:
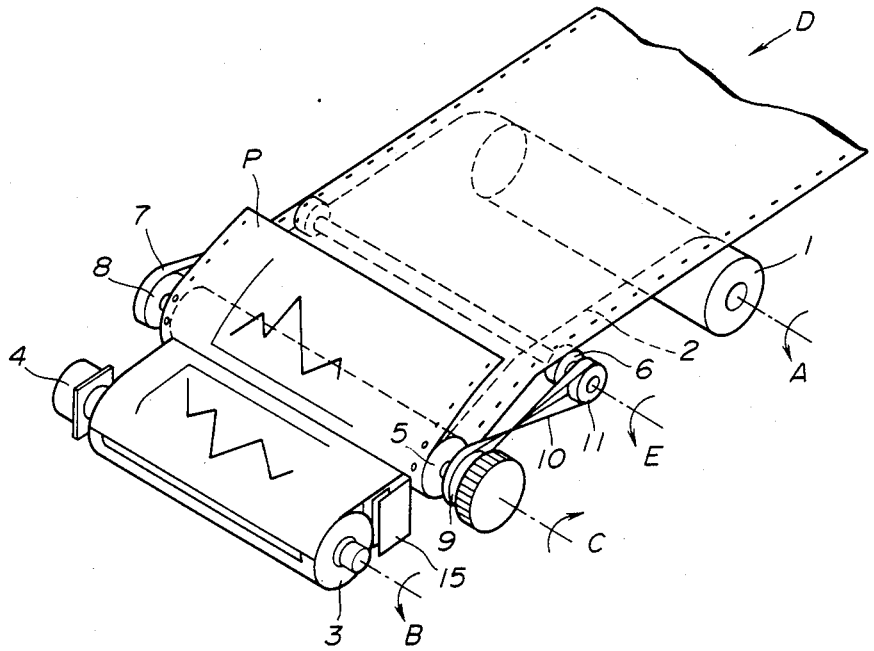
FIG. 1 (PRIOR ART)
FIG. 1 is a perspective side view showing a diagrammatic constitution of a conventional thermal transfer type printer.
Figure 2:
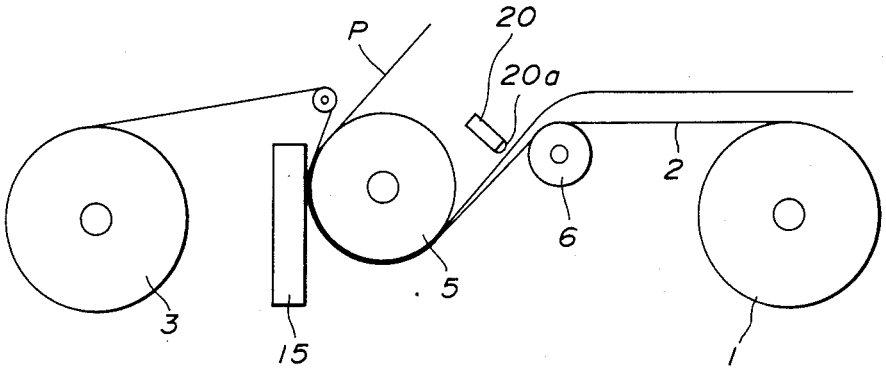
FIG. 2 is a diagrammatic side view showing a mechanical constitution of an embodiment of the present invention.

Referring now to the drawings, wherein like reference characters designate like or corresponding parts throughout the several views, FIG. 2 is a diagrammatic side view showing a mechanical constitution of a thermal transfer type printer according to an embodiment of the present invention.

In FIG. 2, 20 designates a reflection type photo sensor provided in the neighborhood of the platen roller 5. A light transmitting portion 20*a* of the photo sensor 20 faces to the surface of the printing paper P which is drawn in by the platen roller 5 and will be subject to the thermal transfer printing.

Figure 3:
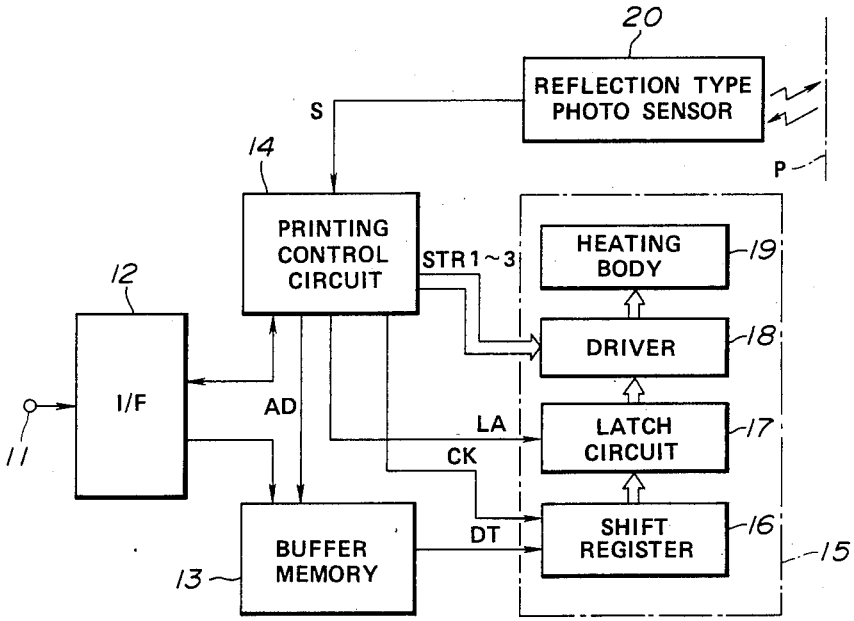
FIG. 3 is a block diagram showing an electric constitution of the embodiment shown in FIG. 2.

Next, FIG. 3 is a block diagram showing an electric constitution of an embodiment of the present invention.

In FIG. 3, 11 designates an input terminal which is supplied with printing data, 12 designates an interface circuit (I/F) 12, 13 designates a buffer memory, and 14 designates a printing control circuit. The printing control circuit 14 generates and outputs addresses AD for write-in and read-out operations to the buffer memory 13. In addition, the printing control circuit 14 generates and outputs several kinds of control signals (i.e., a latch signal LA, a clock pulse CK and strobe pulses $STR_1$ to $STR_3$) to the thermal head 15.

Figure 4:
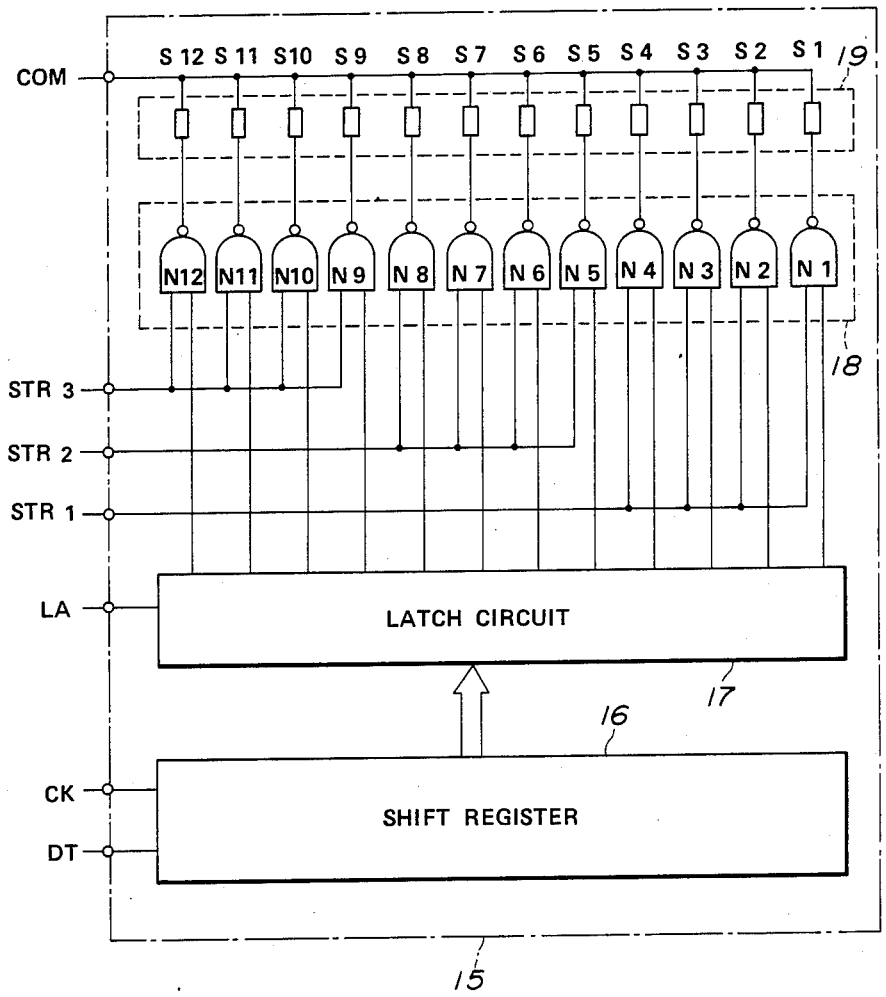
FIG. 4 is a circuit diagram showing a detailed constitution of thermal head shown in FIG. 3.

As shown in FIG. 4, the thermal head 15 is constituted by a shift register 16, a latch circuit 17, a driver 18 and a heating body 19. The shift register 16 is a serial-in/parallel-out shift register wherein serial printing data DT from the buffer memory 13 is sequentially stored therein based on the clock pulse CK and stored serial printing data DT is outputted to the latch circuit 17 in parallel. The latch circuit 17 stores and latches the output parallel data from the shift register 16 based on the latch signal LA, and latched parallel data from the latch circuit 17 is supplied to the driver 18. The driver 18 is constituted by NAND gates $N_1$ to $N_{12}$, and the latched parallel data from the latch circuit 17 is supplied to respective first input terminals of the NAND gates $N_1$ to $N_{12}$. In addition, the strobe pulse $STR_1$ is supplied to second input terminals of the NAND gates $N_1$ to $N_4$, the strobe pulse $STR_2$ is supplied to second input terminals of the NAND gates $N_5$ to $N_8$, and the strobe pulse $STR_3$ is supplied to second input terminals of the NAND gates $N_9$ to $N_{12}$.

The heating body 19 consists of heating elements $S_1$ to $S_{12}$, and output signals of the NAND gates $N_1$ to $N_{12}$ are respectively supplied to the heating elements $S_1$ to $S_{12}$. Incidentally, an actual thermal head provides hundreds of heating elements, however, the thermal head 15 provides only twelve heating elements, for convenience sake.

Meanwhile, the photo sensor 20 consists of a light emitting diode (LED), a phototransistor and a comparator (not shown). The LED emits light toward the printing paper P via the light transmitting portion 20*a*, the phototransistor receives the light reflected by the printing paper P, and the comparator compares the level of output signal of the phototransistor and that of reference voltage. In the case where the ordinary paper is used as the printing paper P, the ordinary paper has a white color surface so that the light emitted from the LED is sufficiently reflected by the white color surface. Hence, the level of output signal from the comparator becomes high (H). On the other hand, in the case where the transparent sheet for OHP is used as the printing paper P, the light emitted from the LED is transmitted via the transparent sheet and is hard to be reflected by the transparent sheet, so that the level of output signal from the comparator becomes low (L).

The above output signal from the comparator within the photo sensor 20 is outputted to the printing control circuit 14 as a detection signal S. The printing control circuit 14 selects one of predetermined two pulse widths for the strobe pulses $STR_1$ and $STR_3$ which are supplied to the driver 18 within the thermal head 15. The above predetermined two pulse widths include a first pulse width which is a reference pulse width and a second pulse width which is shorter than the first pulse width. When the detection signal S having the high level is inputted into the printing control circuit 14, the printing control circuit 14 outputs the strobe pulses $STR_1$ to $STR_3$ having the same first pulse width. When the detection signal S having the low level is inputted into the printing control circuit 14, the printing control circuit 14 outputs the strobe pulses $STR_1$ to $STR_3$ having the same second pulse width.

Next, description will be given with respect to the printing operation of the embodiment.

[A]ORDINARY PAPER IS USED AS PRINTING PAPER P

First, the serial printing data DT from the buffer memory 13 is sequentially stored in the shift register 16. When the serial printing data DT of first line is stored in the shift register 16, the printing control circuit 14 outputs the latch signal LA to the latch circuit 17. At this time, the printing data DT stored in the shift register 16 is stored and latched in the latch circuit 17 in parallel. Then the latched parallel printing data DT is supplied to the driver 18. Next, the printing control circuit 14 outputs the strobe pulse $STR_1$ having the first pulse width to the driver 18 because the photo sensor 20 outputs the detection signal S having the high level to the printing control circuit 14. Due to the strobe pulse $STR_1$, the NAND gates $N_1$ to $N_4$ are activated, and the heating elements $S_1$ to $S_4$ are driven to heat in a first time corresponding to the first pulse width based on the output signals from the latch circuit 17. In this case, the printing control circuit 14 sequentially outputs the strobe pulses $STR_1$ to $STR_3$ in turn by a predetermined time. Therefore, the heating elements $S_5$ to $S_8$ are driven to heat in the first time after the heating elements $S_1$ to $S_4$ are driven to heat. Similarly, thereafter, the heating elements $S_9$ to $S_{12}$ are driven to heat in the first time. Thus, the printing data DT of first line is transferred to the ordinary paper P.

Next, when the printing data DT of first line stored in the shift register 16 is outputted into and stored in the latch circuit 17, the printing data DT of second line outputted from the buffer memory 13 starts to be stored in the shift register 16. Then, when the whole printing data DT of second line is completely stored in the shift register 16, the printing control circuit 14 outputs the latch signal LA to the latch circuit 17 again. Similar to the printing operation of the first line, the printing operation of the second line is performed. Thereafter, the printing operation is repeatedly performed until the last line is printed on the ordinary paper P.

[B]TRANSPARENT SHEET FOR OHP IS USED AS PRINTING PAPER P

In this case, the photo sensor 20 outputs the detection signal S having the low level to the printing control circuit 14 so that the printing control circuit 14 sequentially outputs the strobe pulses $STR_1$ to $STR_3$ having the same second pulse width in turn. Due to the strobe pulses $STR_1$ to $STR_3$, the NAND gates $N_1$ to $N_4$, the NAND gates $N_5$ to $N_8$ and the NAND gates $N_9$ to $N_{12}$ are sequentially activated in turn, therefore, the heating elements $S_1$ to $S_4$, the heating elements $S_5$ to $S_8$ and the heating elements $S_9$ to $S_{12}$ are sequentially driven to heat in turn in a second time corresponding to the second pulse width. Similar to the case [A]described before, the printing operation is performed.

Thus, the heating elements $S_1$ to $S_{12}$ are driven to heat in the first time in the case where the ordinary paper is used as the printing paper P. On the other hand, the heating elements $S_1$ to $S_{12}$ are driven to heat in the second time which is shorter than the above first time in the case where the transparent sheet is used as the printing paper P. Therefore, the heating values of the heating elements $S_1$ to $S_{12}$ are automatically changed in response to the kind of the printing paper P, and the optimum thermal transfer printing can be performed in response to the kind of the printing paper P.

Incidentally, the current-on times of the heating elements $S_1$ to $S_{12}$ are automatically changed so as to change the heating values thereof in the above-mentioned embodiment. However, it is possible to automatically change the heating values of the heating elements $S_1$ to $S_{12}$ by changing the values of the currents flown into the heating elements $S_1$ to $S_{12}$.

Above is the description of the thermal transfer type printer according to an embodiment of the invention.

This invention may be practiced or embodied in still other ways without departing from the spirit or essential character thereof. For instance, the printing paper P is not limited to the ordinary paper and the transparent sheet for OHP, and other kinds of papers can be applied to the present invention. Additionally, the reflection type photo sensor 20 can be replaced by other known photoelectric devices. The preferred embodiment described herein are therefore illustrative and not restrictive, the scope of the invention being indicated by the appended claims, and all variations which come within the meaning of the claims are intended to be embraced therein.

What is claimed is:

1. A thermal transfer type printer including at least a thermal head, a platen roller, a printing paper and a transfer film on which thermal melting ink is painted, one of at least two kinds of printing papers being used for printing, said thermal head including a plurality of heating elements therein, said printing paper and said transfer film being lapped and pressurized between said thermal head and said platen roller, said heating elements within said thermal head being heated in accordance with printing data so that said thermal melting ink is melted and transferred to said printing paper in accordance with an optimum pattern corresponding to said printing data so as to obtain a printed paper, said thermal transfer type printer comprising:

(a) means for detecting the kind of printing paper being used, the printing paper detecting means including means for emitting light onto the printing paper, the light being reflected by the printing paper, and means for sensing the light reflected by the printing paper, the printing paper detecting means outputting a detection signal which varies in accordance with the amount of light reflected by the paper and thereby being indicative of the kind of said printing paper; and (b) control means for changing heating values of said heating elements based on said detection signal when said heating elements are to be heated.

2. A thermal transfer type printer according to claim 1, wherein said printing papers include an ordinary paper and a transparent sheet therein.

3. A thermal transfer type printer according to claim 1, wherein said thermal head further comprises;

(a) a shift register means in which a plurality of said printing data are sequentially stored, said printing data of one line being simultaneously outputted from said shift register means when said printing data of one line are completely stored in said shift register means, and (b) driving means for driving said heating elements to heat in accordance with said printing data of one line so that said printing data of one line are printed on said printing paper.

4. A thermal transfer type printer according to claim 2, wherein said printing paper detection means is a reflection type photo sensor which consists of a light emitting diode, a phototransistor and a comparator, the light emitted from said light emitting diode being reflected by the surface of said printing paper and the reflected light being received and converted into an electrical signal in said phototransistor, said comparator comparing a level of predetermined reference voltage and the level of said electrical signal so as to output said detection signal, the level of said detection signal becoming a first level when said ordinary paper is used as said printing paper, the level of said detection signal becoming a second level when said transparent sheet is used as said printing paper, said control means raising the heating values of said heating elements when said detection signal having said first level is inputted into said control means, and said control means lowering the heating values of said heating elements when said detection signal having said second level is inputted into said control means.

5. A thermal transfer type printer according to claim 4, wherein said control means outputs a plurality of control pulses to said heating elements, said control pulses having one of first and second pulse widths, said first pulse width being longer than said second pulse width, said control pulses being controlled to have said first pulse width when said detection signal having said first level is inputted into said control means, said control pulses being controlled to have said second pulse width when said detection signal having said second level is inputted into said control means.

* * * * *